US011773841B2

(12) United States Patent
Dyer

(10) Patent No.: US 11,773,841 B2
(45) Date of Patent: Oct. 3, 2023

(54) LIQUID DISPENSER COMPRISING PIEZOELECTRIC DETECTOR

(71) Applicant: Hydro Systems Europe Ltd., Hook (GB)

(72) Inventor: Christopher James Dyer, Hook (GB)

(73) Assignee: HYDRO SYSTEMS EUROPE LTD., Hook (GB)

( * ) Notice: Subject to any disclaimer, the term of this patent is extended or adjusted under 35 U.S.C. 154(b) by 236 days.

(21) Appl. No.: 17/220,963

(22) Filed: Apr. 2, 2021

(65) Prior Publication Data

US 2021/0310478 A1 Oct. 7, 2021

(51) Int. Cl.

| | |
|---|---|
| ***F04B 49/06*** | (2006.01) |
| ***F04B 9/105*** | (2006.01) |
| ***F04B 13/02*** | (2006.01) |

(52) U.S. Cl.
CPC ..... *F04B 49/065* (2013.01); *F04B 9/105* (2013.01); *F04B 13/02* (2013.01)

(58) Field of Classification Search
CPC ..... F04B 13/02; F04B 9/105; F04B 49/065
See application file for complete search history.

(56) References Cited

U.S. PATENT DOCUMENTS

| | | | | |
|---|---|---|---|---|
| 4,558,715 | A | 12/1985 | Walton et al. | |
| 4,756,329 | A | 7/1988 | Cloup | |
| 2002/0029018 | A1* | 3/2002 | Jeffrey | A61M 5/1452 604/209 |
| 2009/0130532 | A1 | 5/2009 | Yokozawa et al. | |
| 2018/0200749 | A1* | 7/2018 | Crowell, III | B05D 1/02 |
| 2018/0231407 | A1 | 8/2018 | Lucas et al. | |
| 2019/0082712 | A1* | 3/2019 | Prieto | A23G 1/18 |
| 2019/0092616 | A1* | 3/2019 | Hikem | D06F 39/022 |
| 2019/0293066 | A1 | 9/2019 | Duquennoy et al. | |

FOREIGN PATENT DOCUMENTS

| | | | | |
|---|---|---|---|---|
| EP | 1971774 | A1 | 9/2008 | |
| EP | 1971776 | A1 | 9/2008 | |
| EP | 2853739 | A1 | 4/2015 | |
| FR | 2965864 | A1 | 4/2012 | |
| FR | 3054004 | A1 * | 1/2018 | F04B 13/02 |
| WO | 9605428 | A1 | 2/1996 | |
| WO | WO 2018011185 | A1 | 1/2018 | |

OTHER PUBLICATIONS

Intelelctual Property Office, Search and Examination Report in GB2004952.4, dated Sep. 30, 2020.

* cited by examiner

*Primary Examiner* — Abiy Teka
(74) *Attorney, Agent, or Firm* — Fish & Richardson P.C.

(57) ABSTRACT

A liquid dispenser comprising a liquid pump. The liquid pump comprises a first liquid inlet configured to allow the introduction of a first liquid into a mixing chamber; a second liquid inlet configured to allow the introduction of a second liquid into the mixing chamber; an outlet valve configured to regulate the release of a mixed liquid from the mixing chamber, the mixed liquid being a blend of the first liquid and the second liquid; and a reciprocating member configured to effect a reciprocating movement along a longitudinal axis, the reciprocating member being configured to regulate the aperture of the outlet valve. The liquid dispenser comprises a piezoelectric detector arranged in such a way that when the liquid pump generates a shockwave, the shockwave is detected by the piezoelectric detector, the piezoelectric detector generating a voltage peak which is a function of the shockwave.

15 Claims, 7 Drawing Sheets

LIQUID DISPENSER COMPRISING PIEZOELECTRIC DETECTOR

The present invention belongs to the field of liquid dispensers and, more particularly, to liquid dispensers comprising a liquid pump.

The liquid pump of such liquid dispensers typically comprises at least two liquid inlets to allow for the flow of at least two liquids into a mixing chamber. The introduction of one of the liquids, preferably water, into the mixing chamber, enables the flow of the other liquid into the mixing chamber and moves a reciprocating member which, in turn, determines the aperture of an outlet valve which regulates the release of mixed liquid from the mixing chamber.

This type of liquid dispensers are known in the art, and their components and methods of operation are thoroughly detailed in patent applications such as US 2018/0231407, EP1971776, EP1971774 or FR2965864. US 2018/0231407 explains how the variation in pressure within a supply nozzle of the liquid dispenser may be taken advantage of to determine various operation parameters. In particular, the means for detecting the variation in pressure within the supply nozzle proposed in this document comprises a first volume in fluid communication with the supply nozzle and a second volume separated from the first volume by a flexible membrane. Variations in the supply of liquid within the supply nozzle lead to variations in the supply of liquid within the first volume, which gives rise to deformations in the flexible membrane and, as a consequence, to variations in pressure in the second volume. The second volume may comprise a sensor, such as a piezoelectric sensor, to detect the variations in pressure of the second volume. Additionally, by providing a switch of the reed switch type, the means for detecting variations in pressure may be used for counting working cycles of the liquid pump.

However, the need for at least two dedicated volumes to detect pressure variations may increase the complexity of the liquid dispenser, which may lead to higher costs of manufacture or maintenance. Likewise, the detection of operation parameters is focused on the supply of one the liquids to be blended in the mixing chamber along the supply nozzle. Therefore, operation parameters that may be more closely related to other components of the liquid pump may be overlooked or not accurately detected.

It is therefore desirable to provide a liquid dispenser that may overcome at least some of these disadvantages.

In a disclosure of the invention, a liquid dispenser is provided. The liquid dispenser comprises:

- a liquid pump, in turn comprising:
  - a first liquid inlet configured to allow the introduction of a first liquid into a mixing chamber,
  - a second liquid inlet configured to allow the introduction of a second liquid into the mixing chamber,
  - an outlet valve configured to regulate the release of a mixed liquid from the mixing chamber, the mixed liquid being a blend of the first liquid and the second liquid;
  - a reciprocating member configured to effect a reciprocating movement along a longitudinal axis, the reciprocating movement alternately comprising a first movement and a second movement opposite the first movement, the reciprocating member being configured such that the outlet valve closes when the reciprocating member completes the first movement and such that the outlet valve opens when the reciprocating member completes the second movement, and
- a liquid outlet configured to allow the release of liquid when the outlet valve is open; and
- a piezoelectric detector arranged in such a way that when the liquid pump generates a shockwave, the shockwave is detected by the piezoelectric detector, the piezoelectric detector generating a voltage peak which is a function of the shockwave.

The liquid dispenser comprises a liquid pump. The liquid pump is configured to work as a hydraulic motor which uses a first liquid to activate a reciprocating member. Advantageously, the first liquid may be water. The liquid pump comprises a first liquid inlet configured to allow the introduction of the first liquid into a mixing chamber. The liquid pump also comprises a second liquid inlet configured to allow the introduction of a second liquid into the mixing chamber. In some embodiments, a supply nozzle is provided between a reservoir for the second liquid and the mixing chamber.

The reciprocating member is configured to effect a reciprocating movement along a longitudinal axis, the reciprocating movement alternately comprising a first movement and a second movement opposite the first movement along the longitudinal axis. The second movement may cover substantially a same distance along the longitudinal axis as the first movement. In the transition between the first movement and the second movement, the reciprocating member operates an outlet valve of the mixing chamber to turn the outlet valve closed. In the transition between the second movement and the first movement, the reciprocating member operates the outlet valve of the mixing chamber to turn the outlet valve open. This regulation of the outlet valve may enable a metered release of mixed liquid through the outlet valve. The mixed liquid is a blend of the first liquid and the second liquid. When the outlet valve is open, the mixed liquid is released from the liquid dispenser through a liquid outlet. The pieces of prior art cited above contain several examples disclosing in more detail the way of working of a reciprocating member. Likewise, an additional, non-limiting example is provided below with reference to the figures.

The liquid dispenser of the present disclosure comprises a piezoelectric detector configured to detect shockwaves generated by the liquid pump. The shockwaves may be generated by the movement or friction of one or more components of the liquid pump. For example, the shockwaves may be generated by the reciprocating member and, more particularly, the piezoelectric detector may detect a shockwave generated by the reciprocating member when the reciprocating member turns the outlet valve closed between the first movement and the second movement and when the reciprocating member turns the outlet valve open between the second movement and the first movement. Since the piezoelectric detector generates a voltage peak when a shockwave is detected, the voltage peak being a function of the shockwave, the piezoelectric detector may advantageously enable the determination of the operation parameters of the liquid dispenser associated to a standard or atypical movement of a component of the liquid pump. The detection of operation parameters may be achieved in a reliable and efficient manner, without a need for dedicated structures in the liquid dispenser, such as additional liquid volumes or deformable membranes in a liquid supply nozzle. Put another way, the advantageous arrangement of the piezoelectric detector enables the estimation of operation parameters by directly sensing shockwaves resulting from the movement or frictions of the mechanical components of the liquid pump.

The liquid pump may be configured to generate a first shockwave when the reciprocating member completes the first movement, the piezoelectric detector thus generating a first voltage peak. The liquid pump may also be configured to generate a second shockwave when the reciprocating member completes the second movement, the piezoelectric detector thus generating a second voltage peak. The piezoelectric detector may count a working cycle when it generates either a first voltage peak or a second voltage peak.

By counting a working cycle when the piezoelectric detector generates a first voltage peak, resulting from a first shockwave generated at completion of the first movement (i.e. when the reciprocating member closes the outlet valve), and a second voltage peak, resulting from a second shockwave generated at completion of the second movement (i.e. when the reciprocating member opens the outlet valve), the piezoelectric detector may advantageously be used to efficiently and accurately count working cycles of the liquid dispenser.

Each working cycle corresponds to a completed first movement or a completed second movement. The first and second movements may be substantially equal in length but take place in opposite directions along a longitudinal axis. Therefore, one complete reciprocating movement, comprising a first movement and a second movement, corresponds to two working cycles.

The piezoelectric detector may comprise a positive voltage filter configured to filter a positive voltage peak which is equal to or lower than a positive predetermined voltage threshold, the first predetermined voltage threshold being a positive number. The piezoelectric detector may comprise a negative voltage filter configured to filter a negative voltage peak which is equal to or greater than a negative predetermined voltage threshold.

The provision of a positive predetermined threshold and a negative predetermined threshold may be beneficial to filter voltage values which are less likely to be associated to an operation condition of the liquid dispenser; in particular, the positive predetermined threshold and the negative predetermined threshold may filter voltage values which are less likely to be associated to the first voltage peak or the second voltage peak, that is, to the completion of a first movement or a second movement. This may simplify the process of associating a given voltage peak to a particular operation condition and, more particularly, to a working cycle.

The positive predetermined voltage threshold may be 0.01 Volts and the negative predetermined voltage threshold may be −0.02 Volts.

Such positive predetermined voltage threshold and negative predetermined voltage threshold may be particularly suitable to filter voltage values which are less likely to be associated to an operation condition of the liquid dispenser and, in particular, to the completion of the first movement or the second movement.

The liquid dispenser may comprise an amplifier configured to amplify the voltage generated by the piezoelectric detector.

The provision of an amplifier may allow for an improved detection of the voltage peaks generated by the piezoelectric detector.

When an amplifier is provided, the positive predetermined voltage threshold and the negative predetermined voltage threshold may be adapted in such a way the amplification factor of the amplifier is taken into account.

The positive voltage filter and the negative voltage filter may be configured to filter any voltage within a predetermined filtering time triggered by a voltage peak not filtered by the positive voltage filter or the negative voltage filter.

Put another way, when the liquid pump generates a shockwave detected by the piezoelectric detector, and the shockwave generates a positive voltage peak greater than the positive predetermined threshold or a negative voltage peak lower than the negative predetermined threshold (that is, a voltage which is filtered by neither the positive voltage filter nor the negative voltage filter), the positive voltage filter and the negative voltage filter may be configured to filter any voltage (irrespective of its absolute value) subsequent to such voltage peak for a predetermined filtering time. Therefore, the voltage peak greater than the positive predetermined threshold or lower than the negative predetermined threshold determines the start of an interval of the predetermined filtering time.

The predetermined filtering time may be useful to avoid that two or more voltage peaks associated to the same operation parameter are detected. For example, the predetermined filtering time may avoid that two or more voltage peaks are generated as a result of the completion of a single first movement or a single second movement. Therefore, the predetermined filtering time may simplify the detection of the first voltage peak and the second voltage peak. This may improve the accuracy of the count of working cycles.

The predetermined filtering time may be chosen as a function of the maximum speed of the reciprocating member, so as to ensure that the same interval of the predetermined filtering time does not filter voltage peaks corresponding to the completion of different movements of the reciprocating member even when the reciprocating member moves at its maximum speed.

The predetermined filtering time may be 100 milliseconds.

A predetermined filtering time of 100 milliseconds may be particularly beneficial to avoid that two or more voltage peaks associated to the same operation parameter are detected.

The piezoelectric detector may be configured to count a working cycle when a voltage peak not filter by the positive voltage filter or the negative voltage filter is generated.

The positive voltage filter and the second voltage filter may be configured, as explained above, to filter voltage peaks which do not result from the completion of a first movement or a second movement or which result from the completion of a first movement or a second movement which has already generated an unfiltered voltage peak. Put another way, the appropriate selection of the positive predetermined voltage threshold, the negative predetermined voltage and the predetermined filtering time may enable the piezoelectric detector to count a working cycle when a voltage peak not filter by the positive voltage filter or the negative voltage filter is generated. Since a voltage peak may be directly associated to a working cycle, the count of working cycles may be carried out in a particularly efficient and simplified manner.

The piezoelectric detector may be disposed substantially perpendicularly to the longitudinal axis.

This perpendicular arrangement may be advantageous to enhance the detection of the shockwaves generated by the liquid pump by the piezoelectric detector and, more particularly, shockwaves generated by the reciprocating member.

The piezoelectric detector may be disposed on a mixing chamber outer housing of the liquid dispenser. In an embodiment, the mixing chamber outer housing comprises a lid configured to be disposed substantially perpendicularly to the longitudinal axis when the lid is at a closed position. The piezoelectric detector may be disposed on the lid.

By placing the piezoelectric detector on the lid, the detection of the shockwaves generated by the liquid pump may be improved, since the shockwaves may reach the piezoelectric detector more easily.

The liquid pump may comprise a dosage adjuster movable with respect to the mixing chamber outer housing, the dosage adjuster being configured to regulate the distance covered by the reciprocating member along the longitudinal axis in the first movement and the second movement in function of the relative position between the dosage adjuster and the mixing chamber outer housing, thus regulating the amount of liquid released through the liquid outlet during a single reciprocating movement (more particularly, during the first movement of such reciprocating movement).

As is known in the prior art, and as explained below in a non-limiting example with reference to the figures, the amount of mixed liquid which is released through the liquid outlet during a reciprocating movement may depend on the length of the first movement and the second movement. Such length may be advantageously adjusted with a dosage adjuster which regulates the distance covered by the reciprocating member during the first and second movements.

In an embodiment, the reciprocating member comprises a dosage piston configured to extend upstream of the second liquid inlet along a supply nozzle for supplying the second liquid. The dosage adjuster may be provided integrally with the supply nozzle. The supply nozzle may constitute the dosage adjuster. The supply nozzle may be adjustable with respect to the outer housing. In an embodiment, the supply nozzle is configured to move helicoidally with respect to the outer housing, such that the supply nozzle moves linearly with respect to the outer housing when the supply nozzle rotates with respect to the outer housing. The relative movement between the supply nozzle and the outer housing causes a similar relative movement between the dosage adjuster and the outer housing. The dosage adjuster can be therefore adjusted to come into contact with the dosage piston at a given position so as to limit the movement of the dosage piston accordingly, thus limiting the reciprocating movement of the reciprocating member to the chosen distance that gives rise to a particular release of mixed liquid.

The liquid dispenser may comprise a printed circuit board (PCB) which is integral with the mixing chamber outer housing and a coiled target which is configured to move as a function of the movement of the dosage adjuster, such that the coiled target is configured to determine the relative position between the dosage adjuster and the mixing chamber outer housing, thus determining the amount of liquid released through the liquid outlet during a single reciprocating movement.

Preferably, the PCB may comprise a coiled arrangement. The coiled target and the PCB comprising a coiled arrangement may advantageously provide an inductive measurement which is a function of the relative position of the coiled target and the PCB. In an embodiment, the coiled target is configured to move linearly along a planar PCB. The association of an inductive measurement to a given relative position between the coiled target and the PCB allows for an accurate and cost efficient solution to determine the amount of liquid released through the liquid outlet during a single reciprocating movement. Such arrangement may be particularly beneficial when the coiled target is configured to move linearly along a planar PCB, since this simplifies the determination of the relative position between the dosage adjuster and the mixing chamber outer housing.

In the embodiment where the dosage adjuster is provided integrally with the supply nozzle or when the supply nozzle forms the dosage adjuster, the coiled target may be configured to move linearly along the planar PCB when the supply nozzle moves helicoidally with respect to the mixing chamber outer housing. This configuration may be advantageous to provide a regulation of the amount of liquid released through the liquid outlet during a single reciprocating movement which is both easy to adjust and easy to measure.

The liquid dispenser may comprise a controller electrically connected to the piezoelectric detector.

The controller may be advantageously used to determine the association of a generated voltage peak to a given operation parameter. Preferably, the controller may be configured to associate a voltage peak to a transition between the first movement and the second movement or between the second movement and the first movement. In the latter case, the controller may count the number of working cycles.

The controller may also be configured to operate other functions of the liquid dispenser.

The controller may be electrically connected to the PCB.

When the controller is electrically connected to the PCB, the controller may advantageously be used to calculate the release of mixed liquid through the liquid outlet during a single reciprocating movement by detecting the relative position of the dosage adjuster with respect to the mixing chamber outer housing. In the embodiment wherein the liquid dispenser comprises a coiled PCB integral with the mixing chamber outer housing and a coiled target which moves as a function of the movement of the dosage adjuster, the controller may be used to calculate the release of mixed liquid through the liquid outlet using the inductive measurement generated by the PCB and the coiled target.

The controller may therefore be configured to determine the amount of liquid released through the liquid outlet within a time period based on the number of working cycles counted by the piezoelectric detector within the time period and on the amount of liquid released through the liquid outlet during a single reciprocating movement determined by the coiled target.

The controller may comprise a display unit configured to display information of the liquid dispenser.

The display unit may advantageously be used to display the information of the liquid dispenser such that it can be easily and quickly understood by a user of the liquid dispenser. In an example, the liquid display displays the number of working cycles per minute, the total number of cycles within a time period, the amount of mixed liquid released through the liquid outlet during a single reciprocating movement and the amount of liquid released through the liquid outlet within the time period. From the latter operation parameter, the display unit may also display the amount of mixed liquid released through the liquid outlet within a certain unit of time, that is, the volumetric flow rate. The display unit may be configured to display one or more operation parameters in different units. For example, the volumetric flow rate may be displayed in gallons per minute or litres per minute, among other units.

The controller may be configured to be connected to a remote device, such as a computer or a smartphone.

The remote device may be advantageously used to display the information of the liquid dispenser in the same manner as the display unit for users who are operating or checking the liquid dispenser remotely. Likewise, the remote device may be useful to operate the functions of the liquid dispenser which are controllable with the controller remotely from the controller.

The liquid dispenser may comprise a power supply configured to provide power to the liquid pump or to other components of the liquid dispenser.

The power supply may comprise, among other sources of energy, a battery integrated into the liquid dispenser, an external battery pack, a solar energy generator, a linear magnet generator or a paddle wheel which allows manual generation of energy when no other sources of energy are available.

These and other features and advantages of the invention will become more evident in the light of the following detailed description of preferred embodiments, given only by way of illustrative and non-limiting example, in reference to the attached figures.

Figure 1:
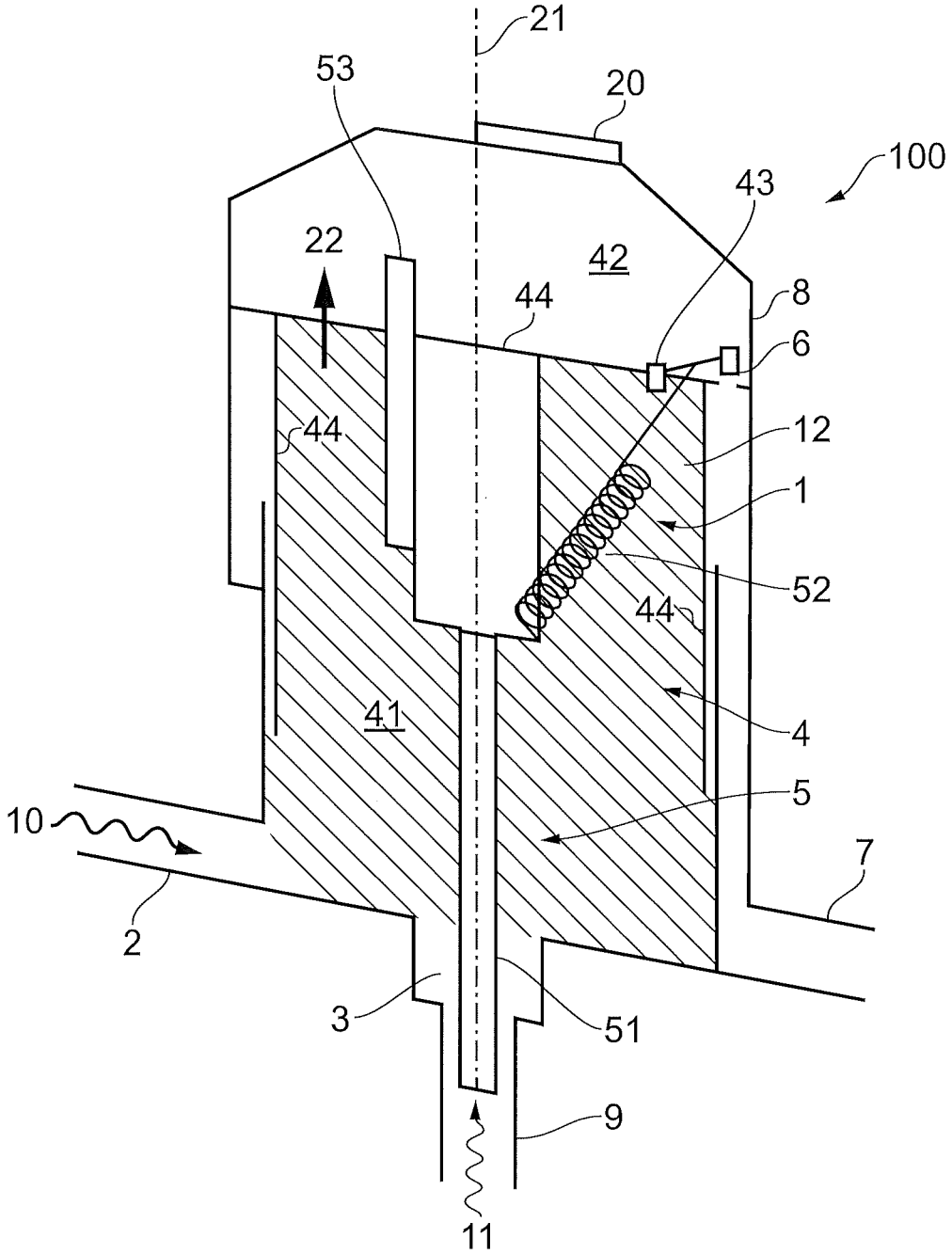
FIG. 1 shows a cross section of a liquid dispenser during an instant of an initial first movement.

FIG. 1 illustrates a liquid dispenser 100 which comprises a liquid pump 1. The liquid pump 1 comprises a first liquid inlet 2 configured to allow the introduction of a first liquid 10 into a mixing chamber 4. The liquid pump 1 also comprises a second liquid inlet 3 configured to allow the introduction of a second liquid 11 from a reservoir (not represented in FIG. 1) along a supply nozzle 9 into the mixing chamber 4. The introduction of the first liquid 10 and second liquid 11 through the first liquid inlet 2 and the second liquid inlet 3 are represented with curved arrows in FIGS. 1 to 3.

The reservoir may be provided with a detector configured to determine or estimate the amount of second liquid 11 stored in the reservoir. In an example, the detector comprises a sensor which determines or estimates the amount of second liquid 11 stored in the reservoir as a function of the time taken by a signal emitted by the sensor to be reflected by the second liquid 11. In another example, the detector comprises a floating element configured to float in the second liquid 11, such that the amount of second liquid 11 stored in the reservoir may be determined or estimated as a function of the position of the floating element.

The liquid pump 1 comprises a reciprocating member 5 configured to effect a reciprocating movement along a longitudinal axis 21, the reciprocating movement alternately comprising a first movement and a second movement opposite the first movement, the second movement covering substantially a same distance along the longitudinal axis 21 as the first movement. In the embodiment of FIG. 1, the first movement is an upwards movement represented with arrow 22, according to the references of FIG. 1.

The mixing chamber 4 of FIG. 1 comprises a first sub-chamber 41 in direct fluid contact with the first liquid inlet 2 and the second liquid inlet 3. The reciprocating member 5 is configured in such a way that the introduction of the first liquid 10 into the first sub-chamber 41 exerts a pressure on the reciprocating member 5 to initiate the first movement. The reciprocating member 5 comprises a dosage piston 51 which is configured to control the flow of the second liquid 11 into the first sub-chamber 41 through the second liquid inlet 3. In this embodiment, when the first movement is initiated, the movement of the dosage piston 51 within the supply nozzle 9 allows the introduction of the second liquid 11 into the first sub-chamber 41 through the second liquid inlet 3. In an example, the upwards movement of the dosage piston 51 during the first movement moves a seal (not represented) disposed around the supply nozzle 9 to a position in direct contact with a flange (not represented) disposed in parallel to the seal and also around the supply nozzle 9. This allows the second liquid 11 to be drawn from the reservoir into the supply nozzle 9 and, subsequently, into the first sub-chamber 41. Therefore, the first liquid 10 and the second liquid 11 blend within the first sub-chamber 41, as represented in FIG. 1 with parallel lines 12. In this example, the downwards movement of the dosage piston 51 during the second movement moves the seal to a position without contact with the flange, which allows the second liquid 11 to bypass the supply nozzle 9. Therefore, in this example, the second liquid 11 is introduced into the mixing chamber 4 only during the first movement of the reciprocating movement.

The mixing chamber 4 of this embodiment also comprises a second sub-chamber 42 which is in fluid contact with the first sub-chamber 41 through an mixing chamber inner valve 43. The second sub-chamber 42 is separated from the first sub-chamber 41 by means of movable walls 44 which move integrally with the reciprocating member 5. Therefore, the first sub-chamber 41 and the second sub-chamber 42 are defined by the movables walls 44 and by a mixing chamber outer housing 8 which remains integral relative to the first liquid inlet 2 and the second liquid inlet 3. The mixing chamber inner valve 43 of this embodiment is mechanically connected to the reciprocating member 5 in such a way that the mixing chamber inner valve 43 remains closed during the first movement. FIG. 1 represents an initial first movement of the reciprocating member 5, that is, a first movement immediately after the start of the flow of first liquid 10 through the first liquid inlet 2. Since the mixing chamber inner valve 43 is closed during the first movement, and there was no liquid within the mixing chamber 4 prior to the first movement depicted in FIG. 1, the second sub-chamber 42 contains no liquid in the instant represented in FIG. 1.

The second sub-chamber 42 is in fluid contact with a liquid outlet 7 through an outlet valve 6. The outlet valve 6 is mechanically connected to the reciprocating member 5 in such a way that the outlet valve 6 remains open during the first movement. In other words, the outlet valve 6 is open when the mixing chamber inner valve 43 is closed. Since the second sub-chamber 42 contains no liquid in the instant represented in FIG. 1, there is no release of liquid through the liquid outlet 7 despite the fact that the outlet valve 6 is open.

In the embodiment of FIG. 1, the reciprocating member 5 is mechanically connected to the mixing chamber inner valve 43 and to the outlet valve 6 by means of a spring mechanism 52. The spring mechanism 52 is configured to flip over the mixing chamber inner valve 43 and the outlet valve 6 in the transition between the first movement and the second movement and between the second movement and the first movement. Therefore, when the first movement is completed, the mixing chamber inner valve 43 opens, the outlet valve 6 closes and the second movement starts. In the embodiments of the figures, the reciprocating member 5 comprises a plunger 53 which tops an inner wall of the mixing chamber outer housing 8 in the transition between the first movement and the second movement.

Figure 2:
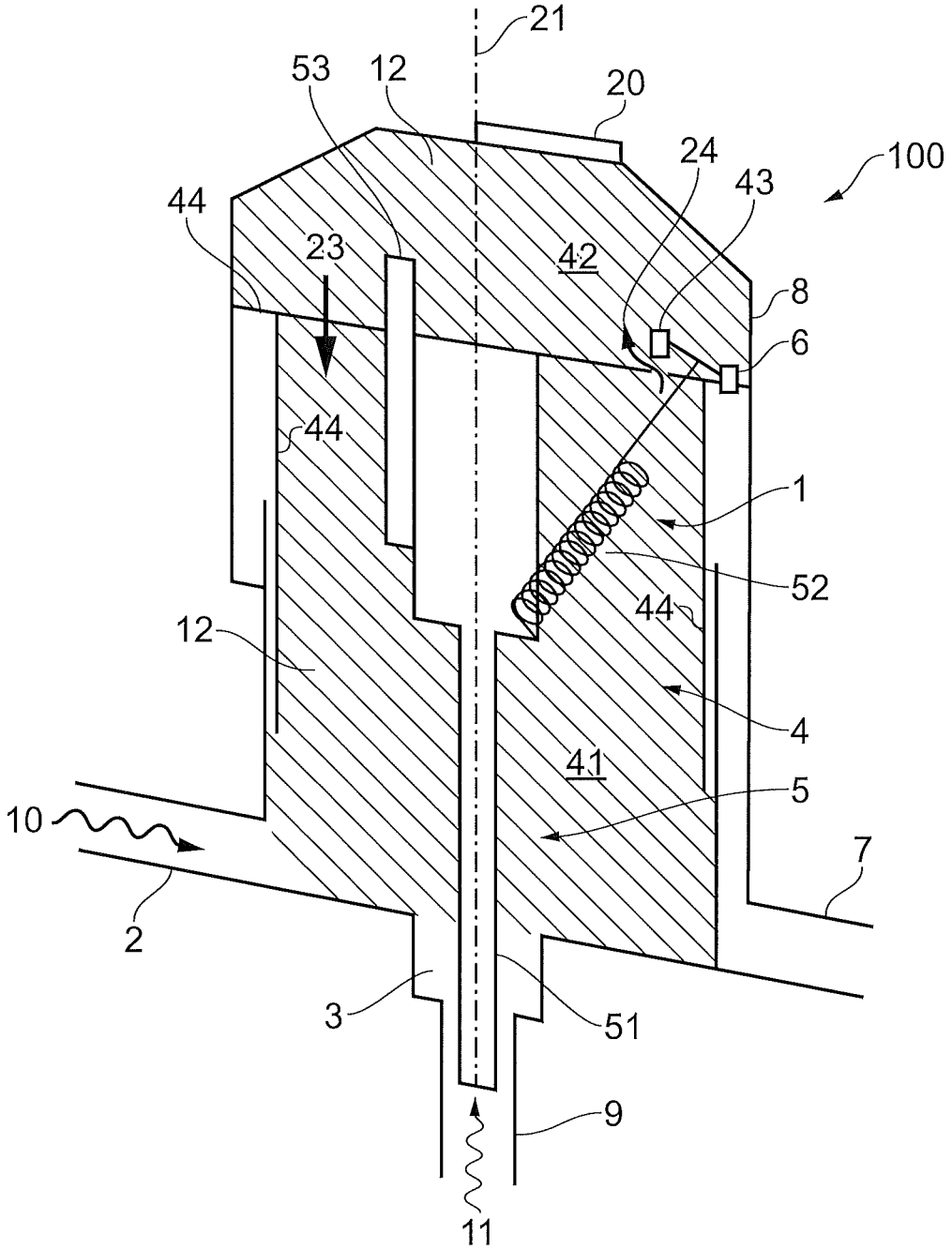
FIG. 2 depicts a cross section of the liquid dispenser during an instant of a second movement.

FIG. 2 shows the liquid dispenser 100 at an instant of the second movement. The second movement of the embodiments of the figures is a downward movement of the reciprocating member 5 represented with arrow 23, with reference to the figures. The movable walls 44 move integrally with the reciprocating member 5 such that the volume of the second sub-chamber 42 increases during the second movement. Likewise, the mixing chamber inner valve 43 is open during the second movement, such that the blend of first liquid 10 and second liquid 11 formed in the first sub-chamber 41 during the first movement flows into the second sub-chamber 42 through the mixing chamber inner valve 43, as represented by arrow 24. Hence, in the instant of FIG. 2, both the first sub-chamber 41 and the second sub-chamber 42 contain a blend 12 of first liquid 10 and second liquid 11. In the embodiments of the figures, the diameter of the second sub-chamber 42 is greater than the diameter of the first sub-chamber 41. The resulting differences of pressures enables the downward movement 23 of the reciprocating member 5 and the moving walls 44 during the second movement. The second sub-chamber 42 reaches its maximum volume at the end of the second movement. It can be thus appreciated that the distance covered by the reciprocating member 5 in the second movement determines the volume of liquid that can be stored within the second sub-chamber 42. As depicted in FIG. 2, the spring mechanism 52 maintains the outlet valve 6 closed during the second movement.

When the second movement is completed, the spring mechanism 52 of the reciprocating member 5 flips over the mixing chamber inner valve 43, which closes, and the outlet valve 6, which opens. A further first movement starts, such that the reciprocating movement 5 and the movable walls 44 move upwards as represented by FIG. 2, according to the reference of the figures. The pressure exerted by the movable walls 44 forces the blend 12 of first liquid 10 and second liquid 11 out of the second sub-chamber 42 through the outlet valve 6 during the first movement, as represented by arrow 25 in FIG. 3. The blend 12 of first liquid 10 and second liquid 11 flows along a liquid outlet 7 which enables the release of the mixed liquid from the liquid dispenser, as illustrated by arrow 13. In turn, the flow of first liquid 10 into the first sub-chamber 41 moves the reciprocating member 5 and the movable walls 44 upwards, as explained for FIG. 1, and allows the introduction of the second liquid 11 into the first sub-chamber 41 through the second liquid inlet 3 by means of the movement of the dosage piston 51 within the supply nozzle 9.

Figure 3:
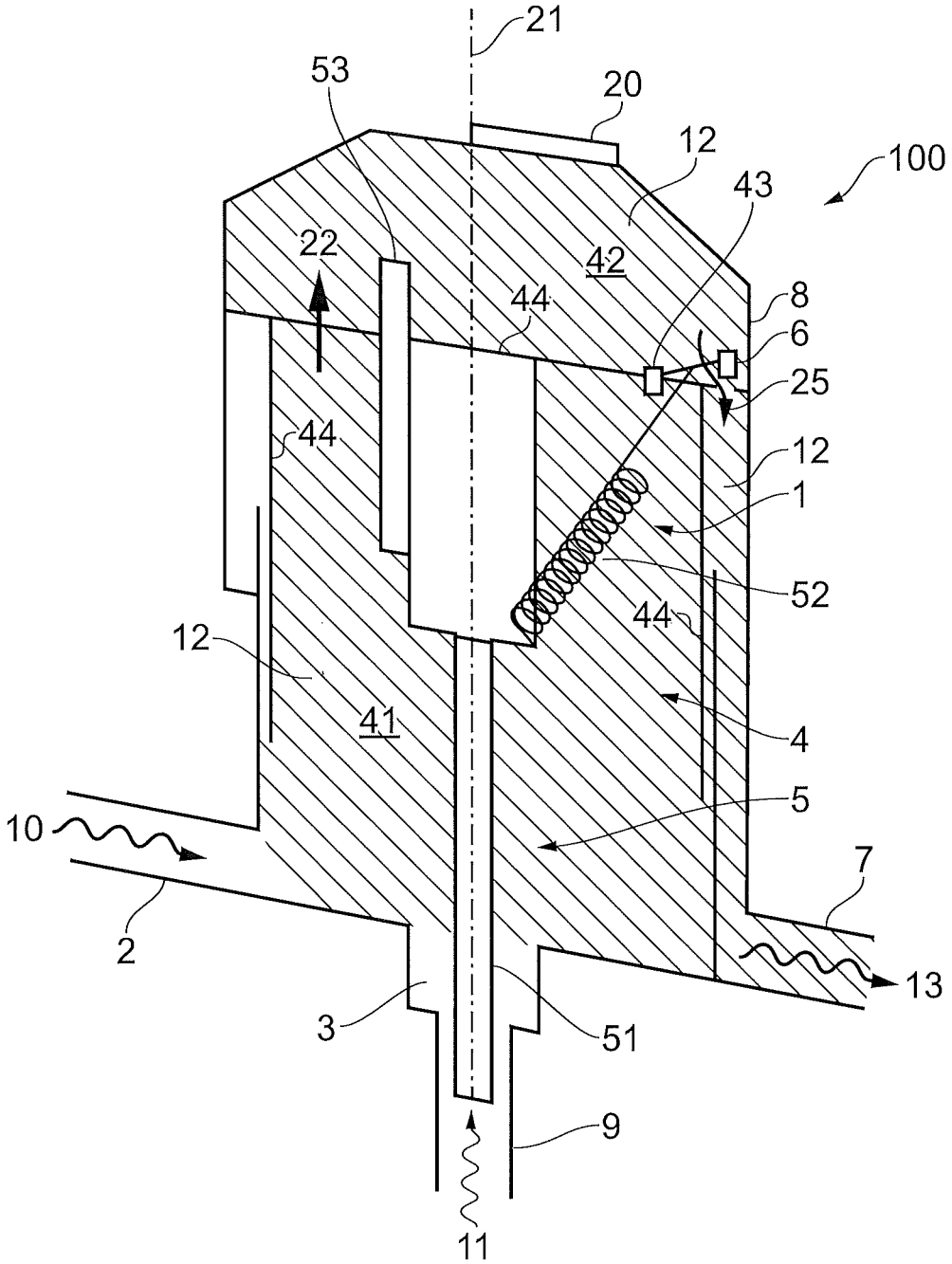
FIG. 3 illustrates a cross section of a liquid dispenser during an instant of a first movement subsequent to the initial first movement.

In the liquid dispenser 100 of FIGS. 1 to 3, a piezoelectric detector 20 is arranged in such a way that when the liquid pump 1 generates a shockwave, the shockwave is detected by the piezoelectric detector 20. The piezoelectric detector 20 generates a voltage peak which is a function of the shockwave. In the embodiments of the figures, the piezoelectric detector 20 is disposed substantially perpendicularly to the longitudinal axis 21 and, more particularly, on an outer wall of the mixing chamber outer housing 8. Commercially available piezoelectric detectors may be employed, such as a Farnell® 1007374-FS-2513P, 80 Hz.

The liquid pump 1 may generate a shockwave due to the movement or friction of one or more of its components, such as the reciprocating member 5. In particular, it has been found that the flip over of the mixing chamber inner valve 43 and the outlet valve 6 by means of the spring mechanism 52 may generate a shockwave which leads to voltage peaks having a greater absolute value than the voltage peaks generated due to the movement or friction of other components of the liquid pump 1.

Figure 4:
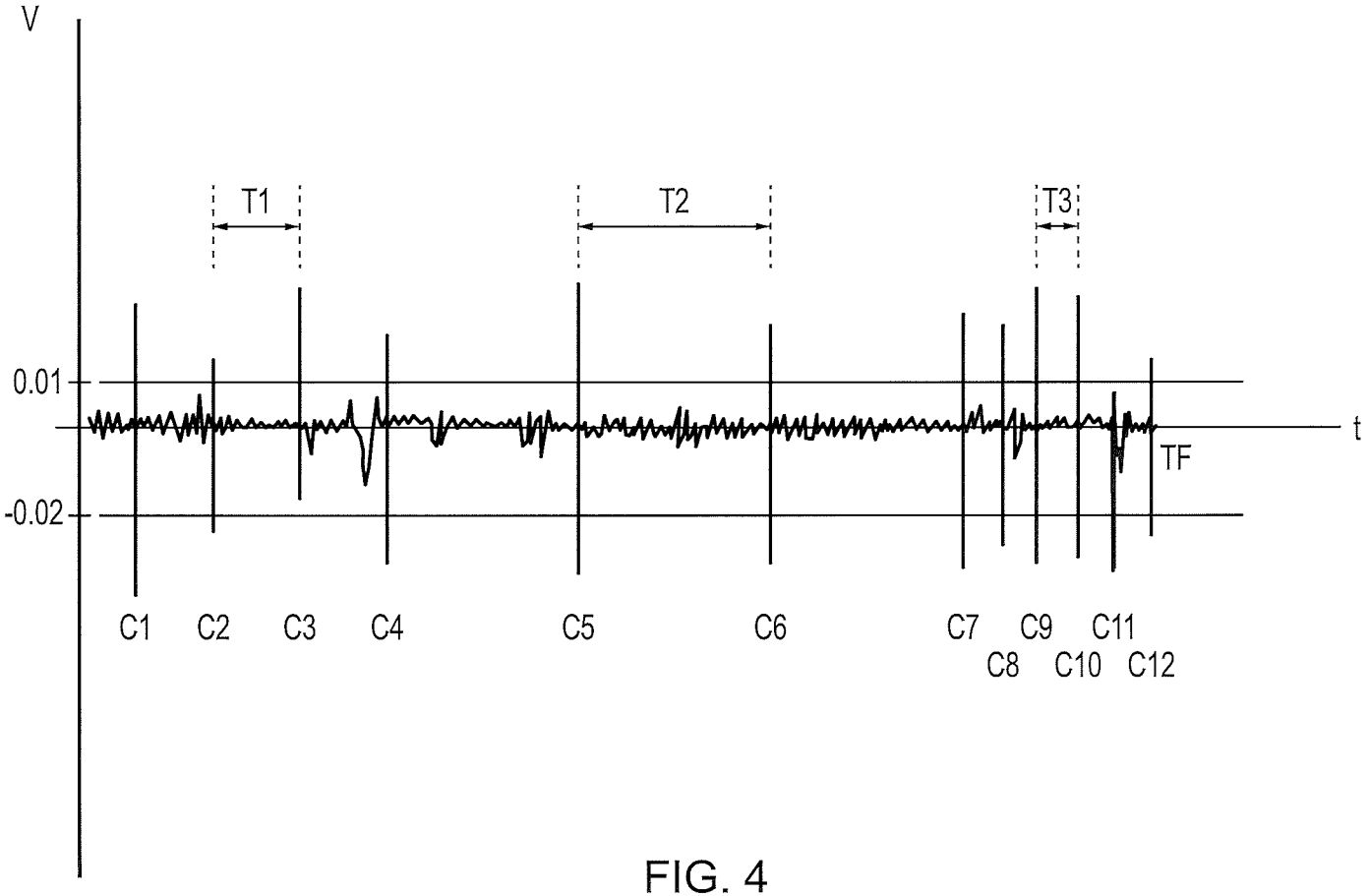
FIG. 4 depicts the detection of voltage peaks by a piezoelectric detector during a given time period.

FIG. 4 illustrates the voltage peaks generated by the piezoelectric detector 5 within a given period of time. The piezoelectric detector 20 of FIG. 4 comprises a positive voltage filter configured to filter a positive voltage peak which is equal to or lower than a positive predetermined voltage threshold, which in the embodiment of FIG. 4 is 0.01 Volts. The piezoelectric detector 20 also comprises a negative voltage filter configured to filter a negative voltage peak which is equal to or greater than a negative predetermined voltage threshold, which in the case of FIG. 4 is −0.02 Volts. The positive predetermined voltage threshold and the negative predetermined voltage threshold are selected so as to ensure that the voltage peaks generated (i.e. not filtered) by the piezoelectric detector 20 result from the flip over of the mixing chamber inner valve 43 and the outlet valve 6 by means of the spring mechanism 52. For example, the positive predetermined voltage threshold and the negative predetermined voltage threshold filter the voltage peaks resulting from the shockwaves caused when the plunger 53 tops the inner wall of the mixing chamber outer housing 8 in the transition between the first movement and the second movement.

The positive voltage filter and the negative voltage filter of the embodiment of FIG. 4 are configured to filter any voltage within a predetermined filtering time triggered by a voltage peak not filtered by the positive voltage filter or the negative voltage filter. In the embodiment of FIG. 4, the predetermined filtering time is 100 milliseconds. The predetermined filtering time is configured to avoid that the same movement or friction of a component of the liquid pump 1 (e.g. the same flip over between the mixing chamber inner valve 43 and the outlet valve 6) generates two consecutive unfiltered voltage peaks.

The appropriate selection of the positive predetermined voltage threshold, the negative predetermined voltage and the predetermined filtering time may enable the piezoelectric detector 20 to count a working cycle when a voltage peak not filter by the positive voltage filter or the negative voltage filter is generated, without a need for discerning if the voltage peak is actually generated by a transition between a first (or a second) movement and a second (or first) movement (that is, by a flip over between the mixing chamber inner valve 43 and the outlet valve 6) or by any other movement or friction of a component of the liquid pump 1.

In the representation of FIG. 4, the piezoelectric detector 20 detects twelve unfiltered voltage peaks which are associated to twelve working cycles C1 to C12 taking place during a time period TF. Put another way, the reciprocating member 5 executes six complete reciprocating movements during such time period TF, each comprising a first movement and a second movement. In the embodiment of FIG. 4, the reciprocating member 5 changes its speed along the longitudinal axis such that the time needed to complete a working cycle varies accordingly. More concretely, working cycles C1 to C4 are separated by a working cycle time T1; working cycles C4 to C7 are separated by a working cycle time T2; and working cycles C7 to C12 are separated by a working cycle time T3.

Figure 5:
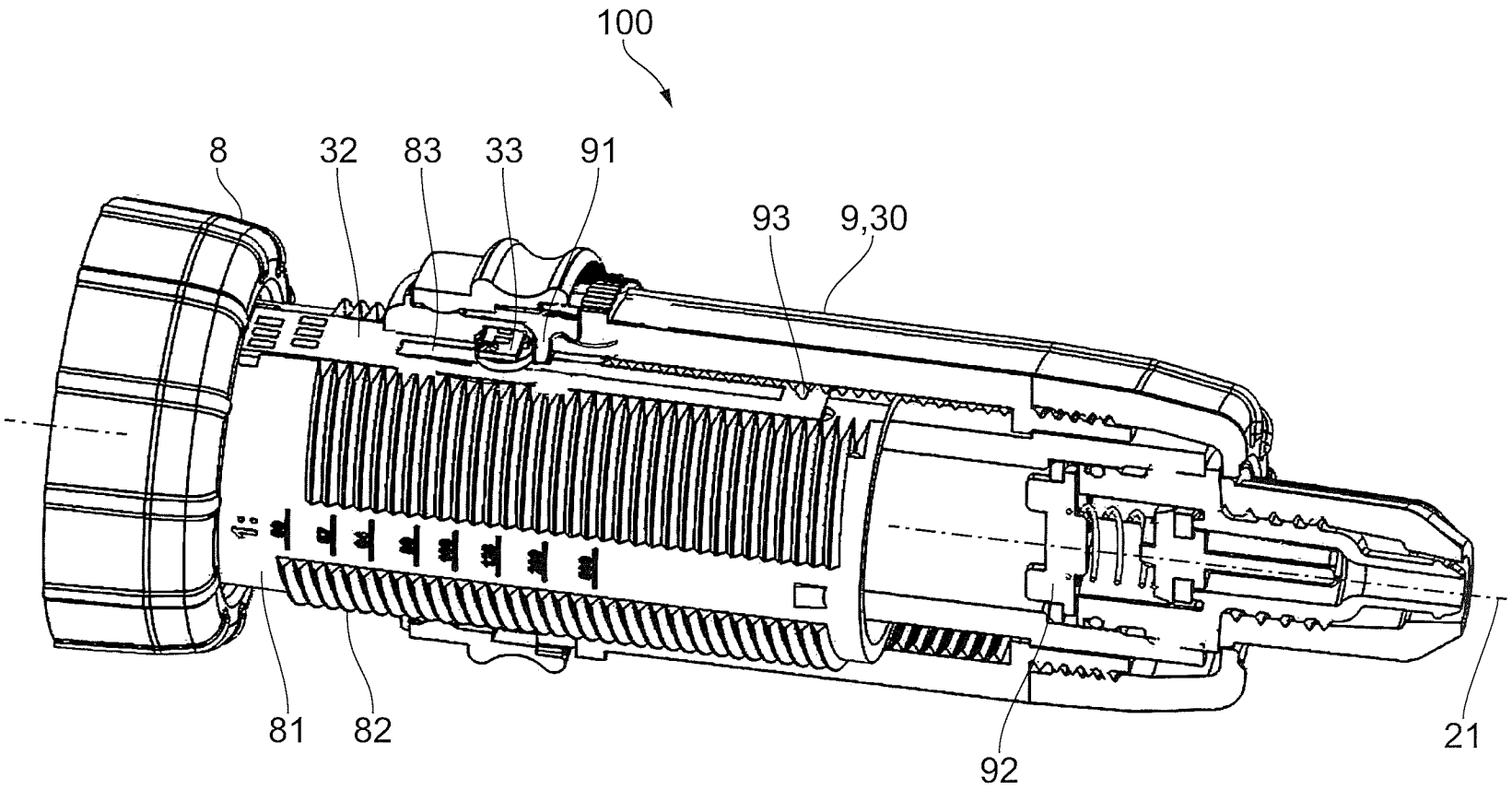
FIG. 5 represents a dosage adjuster for the liquid dispenser of FIGS. 1 to 3.

FIG. 5 shows a dosage adjuster 30 movable with respect to an outer housing 8 of the mixing chamber 4. In the embodiment of FIG. 5, the supply nozzle 9 forms the dosage adjuster 30. The supply nozzle 9 is configured to regulate the distanced covered by the reciprocating member 5 along the longitudinal axis 21 in the first movement and the second movement in function of the relative position between the supply nozzle 9 and the outer housing 8 of the mixing chamber 4. More concretely, in the embodiment of FIG. 5, the supply nozzle 9 is configured to move helicoidally with respect to a tubular extension 81 which is integral with the outer housing 8. Therefore, the supply nozzle 9 moves linearly with respect to the tubular extension 81 when the supply nozzle 9 rotates with respect to the tubular extension 81. In order to allow for the helicoid relative movement between the supply nozzle 9 and the tubular extension 81, the supply nozzle 9 and the tubular extension 81 are respectively provided with a first thread 93 and a second thread 82.

The relative movement between the supply nozzle 9 and the tubular extension 81 causes a relative movement between a dosage piston cylinder 92, which is in mechanical contact with the supply nozzle 9, and the tubular extension 81. In the example of FIG. 5, the helicoid relative movement between the supply nozzle 9 and the tubular extension 81 gives rise to a linear relative movement between the dosage piston cylinder 92 and the tubular extension 81. When the dosage piston 51 moves along the longitudinal axis 21 within the supply nozzle 9, its movement in the direction opposite the mixing chamber 4 is limited by the position of the dosage piston cylinder 92. Such limitation gives rise to a corresponding limitation in the reciprocating movement of the reciprocating member 5. As the distance covered by the reciprocating member 5 in the second movement determines the volume of liquid that can be stored within the second sub-chamber 42, the adjustment of the distanced covered by the reciprocating member 5 during the second movement enables the regulation of the amount of liquid released through the liquid outlet 7 during the first movement (i.e. when the outlet valve 6 is open) of a single reciprocating movement.

The liquid dispenser 100 of FIG. 5 comprises a planar printed circuit board (PCB) 32 which is integral with the outer housing 8 of the mixing chamber 4. In particular, the PCB 32 is provided on an outer wall of the tubular extension 81. The liquid dispenser 100 of FIG. 5 comprises a coiled target 33 which is configured to move as a function of the movement of the supply nozzle 9. More concretely, the liquid dispenser 100 comprises a circumferential rim 91 which is keyed to the tubular extension 81 and which is integral with the coiled target 33. The circumferential rim 91 is in mechanical contact with the supply nozzle 9 in such a way that the helicoid movement of the supply nozzle 9 with respect to the tubular extension 81 makes the circumferential rim 91 move linearly with respect to the tubular extension 81. Therefore, the coiled target 33 follows the linear movement of the supply nozzle 9 with respect to the tubular extension 81. The coiled target 33 is thus configured to determine the relative position between the supply nozzle 9 and the tubular extension 81, which allows to determine the amount of liquid released through the liquid outlet 7 during a single reciprocating movement, as explained in the previous paragraph. In the embodiment of FIG. 4, the supply nozzle 9 (and, therefore, the dosage piston cylinder 92) is kept at the same relative position with respect to the tubular extension 81 during the time period TF, such that the amount of liquid released through the liquid outlet 7 during a single reciprocating movement is fixed to 114.225 millilitres.

In the embodiment of FIG. 5, the PCB 32 comprises a coiled arrangement. The coiled target 33 and the PCB 32 comprising a coiled arrangement provide an inductive measurement which is a function of the relative position between the coiled target 33 and the PCB 32. Thus, the amount of liquid released through the liquid outlet 7 during a single reciprocating movement can be derived from such inductive measurement.

Figure 6:
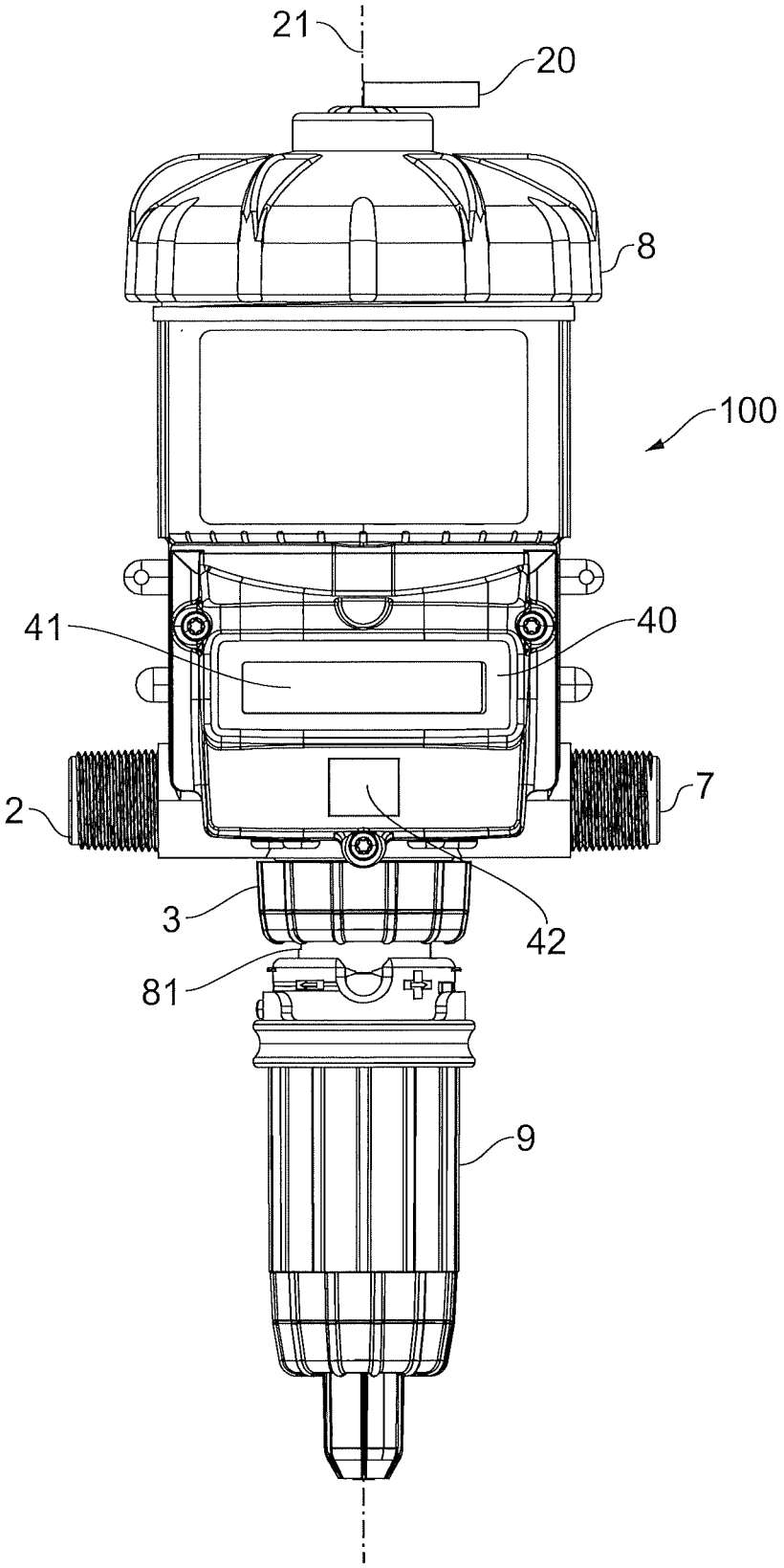
FIG. 6 is a perspective view of the liquid dispenser of FIGS. 1 to 3 seen from outside.
Figure 7:
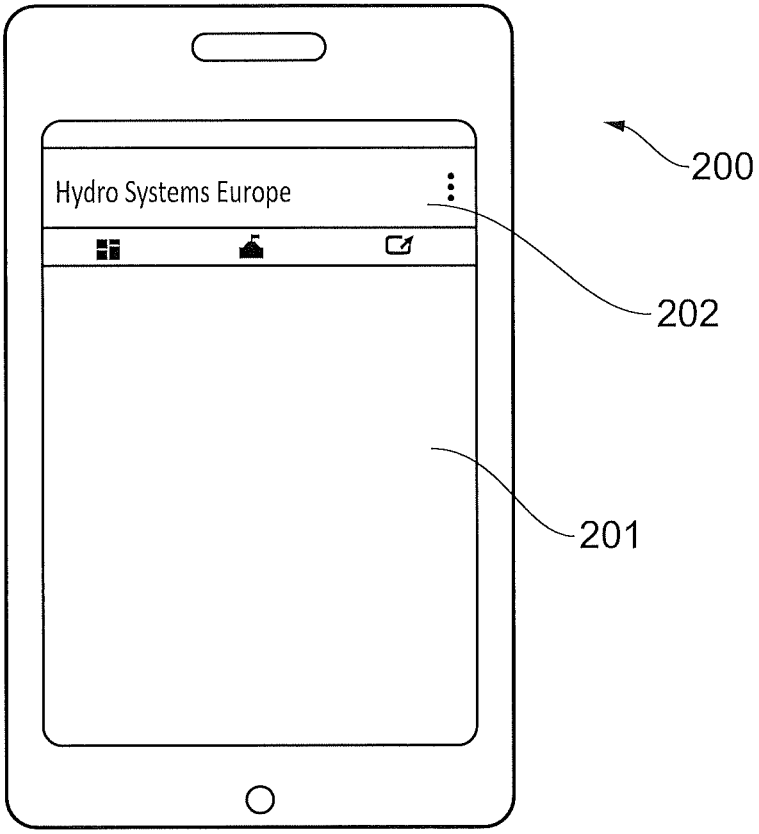
FIG. 7 shows a smartphone comprising an application to display information of the liquid dispenser and to operate functions of the liquid dispenser.

The liquid dispenser 100 of FIGS. 1 to 5 comprises a controller 40 electrically connected to the piezoelectric detector 20 and the PCB 32. The controller 40 is provided on an outer wall of the outer housing 8, as illustrated in FIG. 6. The controller 40 can determine the amount of liquid released through the liquid outlet 7 within a time period based on the number of working cycles counted by the piezoelectric detector within the time period and the amount of liquid released through the liquid outlet during a single reciprocating movement determined by the relative position of coiled target 33 with respect to the PCB 32. In the example of FIG. 4, the amount of liquid released during the represented period of time is 685.35 millilitres, resulting from twelves working cycles, that is, six reciprocating movements, each reciprocating movement allowing a release of 114.225 millilitres during the first movement of the reciprocating member 5.

The controller 40 may also be configured to operate other functions of the liquid dispenser 100.

In the embodiment of FIG. 6, the controller comprises a display unit 41 configured to display information of the liquid dispenser 100.

The controller 40 of FIGS. 1 to 6 is configured to be connected to a remote device, such as a smartphone 200 or a laptop (not represented in the figures). A screen 201 of the smartphone 200 or laptop may also display the information of the liquid dispenser 100 which can be displayed in the displayed unit 41. Likewise, the smartphone 200 or laptop may be used to operate the functions which are controllable with the controller 40 remotely from the controller 40.

The smartphone 200 may include an application (App) 202 running thereon. The controller 40 may be configured to store, for example on an NFC tag, operational parameters to operate at least some of the functions of the liquid dispenser 100. Upon a user presenting the smartphone 200 to the liquid dispenser 100, the operational parameters may be downloaded to the smartphone 200 using the NFC protocol. The smartphone 200 may be configured to automatically start the App 202 upon pairing with an NFC tag. The controller 40 may be configured to store a unique identifier which corresponds to a specific liquid dispenser 100, of which there may be a large number. The identifier may also uploaded to the smartphone 200.

Once the App 202 is running on the smartphone 200, and the data has been downloaded from the NFC tag, the user may, upon first pairing with the smartphone 200, access the information of the liquid dispenser 100, displayed on the screen 201 of the smartphone 200.

The liquid dispenser 100 of FIG. 6 also comprises a battery 42 integrated into the liquid dispenser 100. The battery 42 is configured to provide a voltage of 5 Volts working in DC. The liquid dispenser 100 further comprises a paddle wheel (not represented) which allows manual generation of energy when no other sources of energy are available. The paddle wheel is provided upstream of the first liquid inlet 2.

The invention claimed is:

1. A liquid dispenser comprising:

a liquid pump, comprising:

a first liquid inlet configured to allow introduction of a first liquid into a mixing chamber, a second liquid inlet configured to allow introduction of a second liquid into the mixing chamber, an outlet valve configured to regulate release of a mixed liquid from the mixing chamber, the mixed liquid being a blend of the first liquid and the second liquid, a reciprocating member configured to effect a reciprocating movement along a longitudinal axis, the reciprocating movement alternately comprising a first movement and a second movement opposite the first movement, the reciprocating member being configured such that the outlet valve closes when the reciprocating member completes the first movement and such that the outlet valve opens when the reciprocating member completes the second movement, and a liquid outlet configured to allow release of the mixed liquid when the outlet valve is open; and a piezoelectric detector arranged in such a way that when the liquid pump generates a shockwave, the shockwave is detected by the piezoelectric detector, the piezoelectric detector generating a voltage peak which is a function of the shockwave.

2. The liquid dispenser of claim 1, wherein the liquid pump is configured to generate a first shockwave when the reciprocating member completes the first movement, the piezoelectric detector thus generating a first voltage peak, and wherein the liquid pump is configured to generate a second shockwave when the reciprocating member completes the second movement, the piezoelectric detector thus generating a second voltage peak, such that the piezoelectric detector counts a working cycle when it generates either a first voltage peak or a second voltage peak.

3. The liquid dispenser of claim 2, wherein the piezoelectric detector comprises a positive voltage filter configured to filter a positive voltage peak which is equal to or lower than a positive predetermined voltage threshold, the first positive predetermined voltage threshold being a positive number, and where the piezoelectric detector comprises a negative voltage filter configured to filter a negative voltage peak which is equal to or greater than a negative predetermined voltage threshold.

4. The liquid dispenser of claim 3, wherein the positive predetermined voltage threshold is 0.01 Volts and the negative predetermined voltage threshold is −0.02 Volts.

5. The liquid dispenser of claim 3, wherein the positive voltage filter and the negative voltage filter are configured to filter any voltage within a predetermined filtering time triggered by a voltage peak not filtered by the positive voltage filter or the negative voltage filter.

6. The liquid dispenser of claim 5, wherein the predetermined filtering time is 100 milliseconds.

7. The liquid dispenser of claim 5, wherein the piezoelectric detector is configured to count a working cycle when a voltage peak not filtered by the positive voltage filter or the negative voltage filter is generated.

8. The liquid dispenser of claim 1, wherein the piezoelectric detector is disposed substantially perpendicularly to the longitudinal axis.

9. The liquid dispenser of claim 1, wherein the liquid pump comprises a dosage adjuster movable with respect to a mixing chamber outer housing, the dosage adjuster being configured to regulate a distance covered by the reciprocating member along the longitudinal axis in the first movement and the second movement, thereby regulating an amount of liquid released through the liquid outlet during a single reciprocating movement.

10. The liquid dispenser of claim 9, further comprising a printed circuit board (PCB) integral with the mixing chamber outer housing and a coiled target which is configured to move as a function of the movement of the dosage adjuster, the coiled target being configured to determine a relative position between the dosage adjuster and the mixing chamber outer housing, thus determining the amount of liquid released through the liquid outlet during a single reciprocating movement.

11. The liquid dispenser of claim 10, further comprising a controller electrically connected to the piezoelectric detector.

12. The liquid dispenser of claim 11, wherein the controller comprises a display unit configured to display information of the liquid dispenser.

13. The liquid dispenser of claim 11, wherein the controller is configured to be connected to a remote device.

14. The liquid dispenser of claim 11, wherein the controller is electrically connected to the PCB.

15. The liquid dispenser of claim 14, wherein the controller is configured to determine the amount of liquid released through the liquid outlet within a time period based on:

a number of working cycles counted by the piezoelectric detector within the time period, and the amount of liquid released through the liquid outlet during a single reciprocating movement determined by the coiled target.

* * * * *